US005904809A

United States Patent [19]

Rökman et al.

[11] Patent Number: 5,904,809

[45] Date of Patent: May 18, 1999

[54] INTRODUCTION OF FIBER-FREE FOAM INTO, OR NEAR, A HEADBOX DURING FOAM PROCESS WEB MAKING

[75] Inventors: Kay Rökman; Juhani Jansson, both of Karhula, Finland

[73] Assignee: Ahlstrom Paper Group Oy, Helsinki, Finland

[21] Appl. No.: 08/923,250

[22] Filed: Sep. 4, 1997

[51] Int. Cl.[6] ..... D21F 1/02

[52] U.S. Cl. ..... 162/101; 162/190; 162/289; 162/336; 162/343

[58] Field of Search ..... 162/101, 190, 162/315, 264, 289, 336, 343, 350

[56] References Cited

U.S. PATENT DOCUMENTS

| | | | |
|---|---|---|---|
| 3,716,449 | 2/1973 | Gatward et al. . | |
| 3,871,952 | 3/1975 | Robertson . | |
| 3,938,782 | 2/1976 | Robertson . | |
| 4,049,491 | 9/1977 | Brandon et al. | 162/101 |
| 4,443,297 | 4/1984 | Cheshire et al. . | |
| 4,686,006 | 8/1987 | Cheshire et al. | 162/336 |
| 4,944,843 | 7/1990 | Wallace et al. | 162/101 |
| 5,011,575 | 4/1991 | Keller . | |

*Primary Examiner*—Peter Chin
*Assistant Examiner*—Steven B. Leavitt
*Attorney, Agent, or Firm*—Nixon & Vanderhye P.C

[57] ABSTRACT

In a foam laid process for producing a non-woven web of fibrous material (such as of synthetic or cellulose fibers) substantially fiber free foam is introduced at various locations in or adjacent to a headbox to get improved results. By introducing pure foam into the foam-fiber mixture near (e.g. just before) where the foam-fiber mixture is introduced into the headbox a more uniform basis weight profile of the non-woven web produced may be provided (e.g. a basis weight variation of about 0.5% or less). By introducing another stream of substantially fiber free foam into the headbox at a surface remote from the foraminous element, to flow along the surface (typically parallel to the flow of the foam fiber mixture), it is possible to minimize shear of fibers in the headbox so that the fibers do not become unidirectional, in the direction of movement of the foraminous element, and keep the surface clean. The surface is typically a roof surface of an inclined headbox.

22 Claims, 4 Drawing Sheets

FOAM
98
30I
44
92
30I
93
FOAM
45
90
94
FIBER/
FOAM
29
45
91
32
29
31

INTRODUCTION OF FIBER-FREE FOAM INTO, OR NEAR, A HEADBOX DURING FOAM PROCESS WEB MAKING

BACKGROUND AND SUMMARY OF THE INVENTION

The foam-laid process for forming non-woven fibrous webs is basically disclosed in U.S. Pat. Nos. 3,716,449, 3,871,952, and 3,938,782 (the disclosures of which are incorporated by reference herein). The foam-laid process has a number of advantages over the water-laid process that is most conventionally used for making synthetic or cellulose fiber webs. The invention relates to a method and assembly for implementing the foam-laid process so as to improve aspects thereof.

According to the invention it has been found desirable for a number of different purposes to strategically introduce a substantially pure foam (that is water, air, and surfactant, being substantially fiber-free) adjacent or into a headbox for forming a non-woven web. By introducing the pure foam flow into the flow of a foam-fiber mixture near (e.g. just prior to) introduction of the foam/fiber mixture into the headbox (up to the actual introduction of the foam-fiber mixture thereinto) it is possible to increase the uniformity of the basis weight profile of the non-woven web produced. In fact it is possible to provide a web basis weight variation of less than 0.5%, e.g. as low as 0.2% or perhaps even less depending upon the fibers.

Alternatively, or in addition, by introducing the pure foam flow into the headbox adjacent a surface (such as the roof surface of an inclined headbox) thereof, it is possible to minimize shear of fibers in the headbox so that the fibers do not become unidirectional, in the direction of movement of the foraminous element (wire), and so that the surface is kept clean. These advantageous results may be achieved in a simple and very inexpensive manner, one that essentially introduces almost no additional operating costs and very few additional capital costs.

According to one aspect of the present invention a headbox assembly for producing a non-woven web of fibrous material is provided comprising the following components: A moving foraminous element on which a non-woven web may be formed. A headbox comprising a first surface and a second surface, the second surface remote from the foraminous element, and the headbox adjacent the foraminous element so that a foam fiber mixture in the headbox deposits fibers on the foraminous element. Means for introducing a foam fiber mixture into the headbox. Means for withdrawing foam through the foraminous element to form a non-woven fibrous web on the foraminous element. And, means for passing a substantially fiber free foam into contact with the second surface at a position remote from the foraminous element.

The means for introducing the foam-fiber mixture into the headbox may include a plurality of openings in the first surface, as well as other components that are conventional for introducing a fluid flow into a volume, including conduits, nozzles, orifices, headers, manifolds, or other conventional devices. The means for withdrawing foam through the foraminous element may comprise any conventional structure, such as suction boxes or tables, suction rollers, pressing rollers, or any other conventional components that are capable of performing that function.

The means for passing a substantially fiber-free foam into contact with a second surface may also comprise any type of conventional fluidic element that can accomplish that purpose including conduits of various shapes, sizes, and orientations, nozzles, orifices, headers, manifolds, or any like conventional devices.

The assembly may also comprise means for introducing substantially fiber free foam into the means for introducing a foam fiber mixture into the headbox just prior to the headbox so as to provide a more uniform basis weight profile of the non-woven web produced. Such means may also comprise any conventional fluidic components such as conduits, conduit branches, orifices, manifolds, etc., such as one set of conduits making an angle (e.g. between about 30–90°) to the fiber-foam mixture containing conduit immediately adjacent (up to the actual point of introduction of the foam-fiber mixture) the headbox.

The means for passing a substantially fiber free foam into contact with the second surface at a position remote from the foraminous element may comprise at least one conduit opening adjacent the second surface for causing foam to flow along the second surface toward the foraminous element so as to minimize shear of fibers in the headbox so that the fibers do not become unidirectional, in the direction of movement of the foraminous element, and so as to keep the second surface clean. The assembly may further comprise a baffle adjacent the means for passing a substantially fiber free foam into contact with the second surface at a position remote from the foraminous element to ensure initial flow of the introduced foam along the second surface. The second surface may be a roof surface of the headbox, and the foraminous element may move at an angle to both the horizontal and vertical, the headbox being an inclined headbox.

According to another aspect of the present invention a method of producing a non-woven web of fibrous material, using a headbox, a moving foraminous element, and a surface of the headbox, is provided. The method comprises the following steps: (a) Feeding a first foam slurry of air, water, fibers, and surfactant into the headbox and into contact with the moving foraminous element. (b) Passing a lubricant (preferably a first substantially fiber-free foam) into contact with the surface of the headbox at a point remote from the foraminous element. And, (c) withdrawing foam through the foraminous element to form a non-woven fibrous web on the foraminous element.

Step (b) may be practiced to cause the first foam to flow along the surface toward the moving foraminous element so as to minimize shear of fibers in the headbox so that the fibers do not become unidirectional, in the direction of movement of the foraminous element. The surface of the headbox may comprise a roof surface thereof, and step (b) may be practiced to cause foam to flow along the surface toward the foraminous element so as to also keep the surface clean. The amount of foam added in (b) may be 1–10% by volume of the flow in (a). There may also be the further step of passing a second substantially fiber-free foam into the first foam slurry just before the first foam slurry is fed into the headbox so as to provide a more uniform basis weight profile of the non-woven web produced.

Step (a) is typically practiced so that the first fiber-foam slurry flows in substantially the same direction as the first substantially fiber-free foam. Step (b) may also be practiced by providing a baffle in the headbox which assists in directing the first substantially fiber-free foam along the surface, and so that it does not initially mix with the first fiber-foam slurry introduced into the headbox.

According to another aspect of the present invention a headbox assembly is provided comprising the following components: A headbox associated with a moving foraminous element. Means for feeding a first foam slurry of air, water, fibers, and surfactant into the headbox and ultimately into contact with the moving foraminous element. Means for withdrawing foam through the foraminous element to form a non-woven web on the foraminous element. And, means for passing a second, substantially fiber-free foam, into the first foam slurry near (e.g. just before) where the first foam slurry is fed into the headbox. The means for feeding, withdrawing, and passing may have the modifications such as discussed above.

The means for feeding may comprise a plurality of foam forming nozzles and a plurality of first conduits connecting the nozzles to the headbox; and the means for passing a second, substantially fiber-free foam, into the first foam slurry just before the first foam slurry is fed into the headbox may comprise a plurality of second conduits associated with at least some of the first conduits and making an angle with respect thereto. The angle between the first and second conduits may be between about 30–90°, and in a vertical plane.

According to yet another aspect of the present invention a method of producing a non-woven web of fibrous material, using a headbox, and a moving foraminous element, is provided. The method comprises the steps of: (a) Feeding a first foam slurry of air, water, fibers, and surfactant into the headbox and into contact with the moving foraminous element. (b) Withdrawing foam through the foraminous element to form a non-woven fibrous web on the foraminous element. And, (c) passing a second, substantially fiber-free foam, into the headbox (e.g. into first foam slurry near (e.g. just before) where the first foam slurry is fed into the headbox), to provide a more uniform basis weight profile of the nonwoven web produced.

Step (a) is typically practiced by moving the fiber-foam slurry in a generally horizontal direction, although in some circumstances it may be moved vertically or at angles. Steps (a) through (c) are typically practiced to produce a non-woven web having a consistency before drying of about 40–60%, and a basis weight variation of less than ½% (e.g. about 0.2%, or even less). The amount of flow in (c) may be between about 2–20%, by volume, the flow in (a).

It is the primary object of the present invention to enhance the foam-laid process for the production of non-woven webs of fibrous material. This and other objects of the invention will become clear from an inspection of the detailed description of the invention and from the appended claims.

DETAILED DESCRIPTION OF THE DRAWINGS

Figure 1:
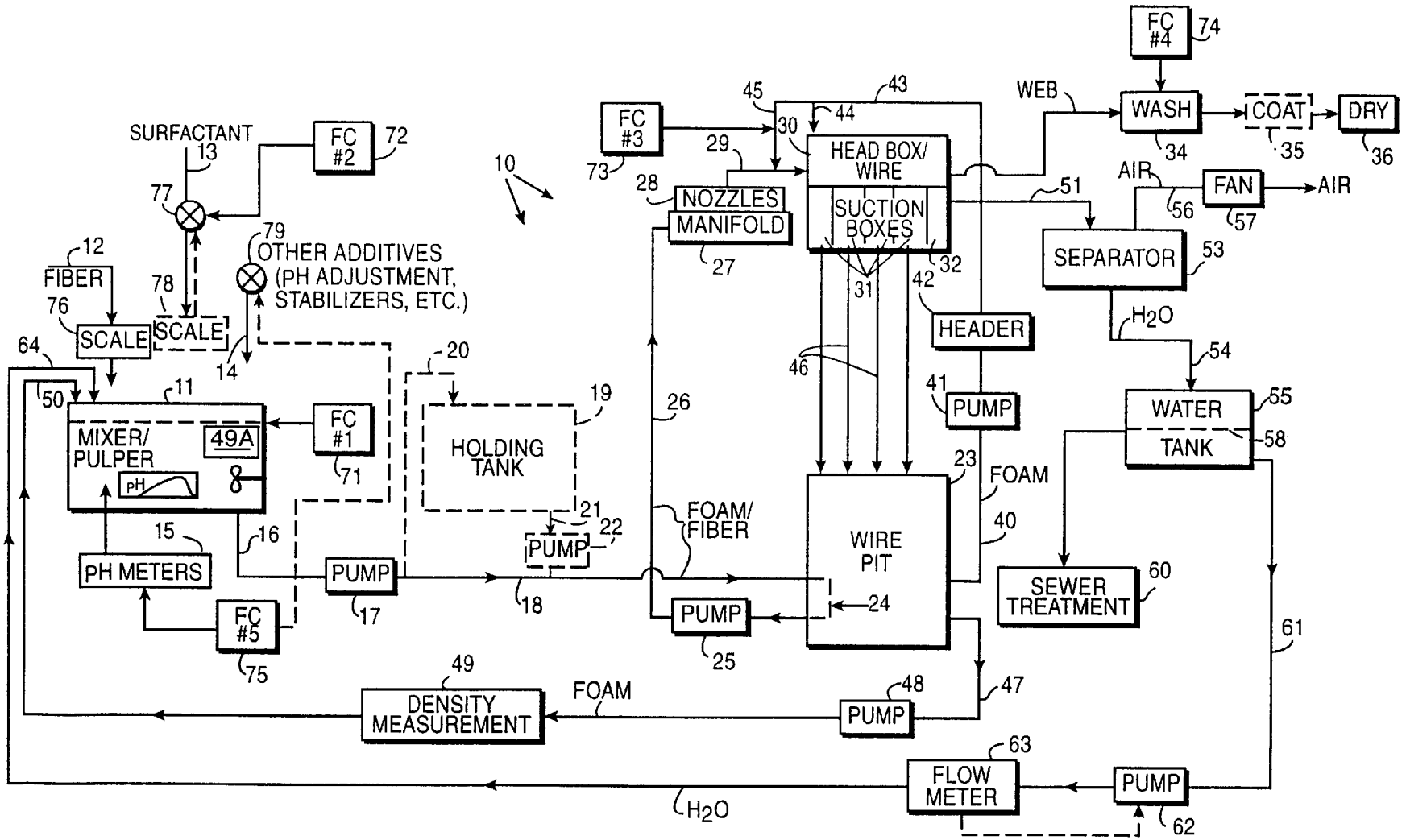
FIG. 1 is a general schematic illustration of a foam laid process system in which the method of the invention may be practiced and the apparatus of the invention utilized.

An exemplary foam-laid process system for practicing a foam laid process with which the invention is desirably utilized is illustrated schematically at 10 in FIG. 1. The system includes a mixing tank or pulper 11 having a fiber input 12, a surfactant input 13, and an input 14 for other additives, such as pH adjustment chemicals like calcium carbonate or acids, stabilizers, etc. The particular nature of the fibers, surfactant, and additives is not critical and they may be varied widely depending upon the exact details of the product being produced (including its basis weight). It is desirable to use a surfactant that can be fairly readily washed out since a surfactant reduces the surface tension of the final web if it is still present, and that is an undesirable feature for some products. The exact surfactant used, from the thousands that are commercially available, is not part of the present invention.

The tank 11 is per se entirely conventional, being the same type of tank that is used as a pulper in conventional paper making systems using the water-laid process. The only differences are that the side walls of the mixer/pulper 11 are extended upwardly about three times the height in the water-laid process since the foam has a density about a third that of water. The rpm and blade configuration of the conventional mechanical mixer in the tank 11 is varied depending upon the particular properties of the product being produced, but is not particularly critical, and a wide variety of different components and variables may be employed. Brakers may also be provided on the walls. There is a vortex at the bottom of the tank 11 from which the foam drains, but the vortex is not visible once start up occurs because the tank 11 is filled with foam and fiber.

The tank 11 also preferably includes therein a large number of pH meters 15 for measuring the pH at a number of different points. pH affects surface tension, and thus desirably is accurately determined. The pH meters are calibrated daily.

At initial start up, water is added with the fiber from line 12, the surfactant from line 13, and other additives in line 14; however, once operation commences no additional water is necessary and there is merely foam maintenance in the tank 11, not merely foam generation.

The foam exits the bottom of the tank 11, in a vortex, into line 16 under the influence of the pump 17. The pump 17, like all other pumps in the system 10, preferably is a degassing centrifugal pump. The foam discharged from the pump 7 passes in line 18 to further components.

FIG. 1 illustrates an optional holding tank 19 in dotted line. The holding tank 19 is not necessary but may be desirable to ensure a relatively even distribution of the fiber in the foam in case there is some variation that is introduced into the mixer 11. That is, the holding tank 19 (which is small, typically only on the order of five cubic meters) acts more or less like a "surge tank" for evening out fiber distribution. Because the total time from mixer 11 to the headbox (30) is typically only about 45 seconds in the practice of the process, the holding tank 19—if used—provides time for variations to even out.

When the holding tank 19 is used foam is fed from the pump 17 in line 20 to the top of the tank 19, and exits the bottom of the tank in line 21 under the influence of centrifugal pump 22, then leading to line 18. That is, when the holding tank 19 is used the pump 17 is not directly connected to the line 18, but only through the tank 19.

The line 18 extends to the wire pit 23. The wire pit 23 is per se a conventional tank, again the same as in the conventional water-laid paper process system, but with higher side walls. It is important to make the wire pit 23 so that there are no dead corners and therefore the tank 23 should not be too large. The conventional structure 24 which allows the foam and fiber mixture in line 18 to be introduced into the pump 25 (which is operatively connected adjacent the bottom of the wire pit 23) will be described further with respect to FIG. 2. In any event, the pump 25 pumps the foam/fiber mixture in line 18, introduced by mechanism 24, and additional foam from the wire pit 23, into the line 26. Because a fairly large amount of foam is drawn into the pump 25 from the wire pit 23, typically the consistency in line 26 is significantly less than that in line 18. The consistency in line 18 is typically between 2–5% solids (fibers), while that in line 26 is typically between about 0.5–2.5%, although the consistency in each case may be as high as about 12%.

In the wire pit 23 there is no significant separation of the foam into layers of different density. While there is a minimal increase toward the bottom, that degree of increase is small and does not affect operation of the system.

From the line 26 the foam/fiber passes to the manifold 27 which has foam generating nozzles 28 associated therewith. Preferably the nozzles 28—which are conventional foam generating nozzles (which agitate the foam greatly) as used in the '449, '952 and '782 patents incorporated by reference herein—are mounted on the manifold 27, and a large number of the nozzles 28 are mounted on the manifold 27. Extending from each nozzle 28 is a conduit 29 which leads to the headbox 30, through which one or more conventional paper making wires (foraminous elements) pass.

The headbox 30 has a plurality of suction boxes (typically about three to five) 31 which withdraw foam from the opposite side of the wire (foraminous element) from the introduction of the foam/fiber mixture, and a final separation box 32 is at the discharge end of the formed web 33 from the headbox 30. The number of suction boxes 31 provided in the suction table to control drainage are increased for denser products, or for higher speed operation. The formed web 33, which typically has a solids consistency of about 40–60% (e.g. about 50%), is preferably subjected to a washing action as indicated schematically by wash stage 34 in FIG. 1. The wash stage 34 is to remove the surfactant. The high consistency of the web 33 means that a minimum amount of drying equipment need be utilized.

The web 33 passes from the washer 34 past one or more optional coaters 35, to the conventional drying station 36. In the conventional drying station 36 when synthetic sheath/core fibers (such as Cellbond) are part of the web 33, the dryer 34 is operated to raise the web above the melting point of the sheath material (typically polypropylene) while the core material (typically PET) does not melt. For example where a Cellbond fiber is used in the web 33, the temperature in the dryer is typically about 130° C. or slightly more, which is at or slightly above the melting temperature of the sheath fiber, but well below the approximately 250° C. melting temperature of the core fiber. In that way a binding action is provided by the sheath material, but the integrity of the product (provided by the core fiber) is not compromised.

While it is not always necessary, the process contemplates the addition of pure foam to or immediately adjacent the headbox 30 for a number of advantageous purposes. As seen in FIG. 1, the centrifugal pump 41 draws foam from the wire pit 23 into line 40. The foam in line 40 is pumped to a header 42 which then distributes the foam to a large number of different conduits 43, toward the headbox 30. The foam may be introduced—as indicated by line 44—directly underneath the roof of the headbox 30 (where it is an incline wire headbox), and/or via conduits 45 to the lines 29 (or nozzles 28) for introducing foam/fiber mixture into the headbox 30. The details of the foam introduction will be described with respect to FIGS. 3 through 6.

The suction boxes 31 discharge the foam withdrawn from the headbox 30 in lines 46 into the wire pit 23. Typically no pumps are necessary, or used, for that purpose.

A significant amount of the foam in the wire pit 23 is recirculated to the pulper 11. The foam is withdrawn in line 47 by centrifugal pump 48, and then passes in conduit 47 through the conventional in-line density measurement device 49 for introduction—as indicated schematically at 50—back into the tank 11. In addition to providing density measurement for the foam in line 47 at 49, as schematically illustrated in FIG. 1 one or more density measuring units (such as denseometers) 49A may be mounted directly in the tank 11.

In addition to foam recycle, there is also typically water recycle. The foam withdrawn from the last suction box 32 passes via line 51 to a conventional separator 53, such as a cyclone separator. The separator 53—e.g. by vortex action—separates air and water from the foam introduced into the separator 53 to produce water with very little air in it. The separated water passes in line 54 from the bottom of the separator 53 to the water tank 55. The air separated by the separator 53 passes in line 56, with the assistance of the fan 57, from the top of the separator 53 and is discharged to atmosphere, or used in a combustion process or otherwise treated.

A liquid level 58 is established in the water tank 55, with some liquid overflowing to sewer or treatment, as indicated schematically at 60 in FIG. 1. Water is also taken from below the level 58 in the tank 55 via line 61, and under the influence of centrifugal pump 62 is pumped in line 61 through a conventional flow meter 63 (which controls the pump 62). Ultimately, the recycled water is introduced—as indicated schematically at 64 in FIG. 1—to the top of the mixer 11.

Typical flow rates are 4000 liters per minute foam/fiber in line 18, 40,000 liters per minute foam/fiber in line 26, 3500 liters per minute foam in line 47, and 500 liters per minute foam in line 51.

The system 10 also includes a number of control components. A preferred example of various alternatives for controlling the operation of the system comprises first fuzzy controller, 71, controls the level of foam in the tank 11. A second fuzzy controller 72 controls the addition of surfactant in line 13. A third fuzzy controller 73 controls web formation in the headbox 30 area. A fourth fuzzy controller 74 is used with the washer 34. A fifth fuzzy controller 75 controls the pH meters 15, and possibly controls addition of other additives in line 14 to the mixer 11. Fuzzy control is also used for surfactant and formation control. A multi-variable control system, and a Neuronet control system, also are preferably provided overlaying the other controls. The multi-variable control also is used for controlling the efflux ratio at web formation. The variables can be changed depending upon their effect on desired process regulation, and end result.

In order to facilitate control of the various components, typically a scale 76 is associated with the fiber introduction 12 in order to accurately determine the amount of fiber being added, per unit time. A valve 77 in line 13 may be provided for controlling the introduction of surfactant, as well as a scale 78. A valve 79 may also be provided in the line 14.

In the system 10 essentially no valves are provided for intentionally contacting the foam at any point during its handling, with the possible exception of level control valves provided in lines 46.

Also, during the entire practice of the process of the system of FIG. 1 the foam is kept under relatively high shear conditions. Since the higher the shear the lower the viscosity, it is desirable to maintain the foam at high shear. The foam/fiber mixture acts as a pseudo-plastic, exhibiting non-Newtonian behavior.

The use of the foam-laid process has a number of advantages compared to the water-laid process particularly for highly absorbent products. In addition to the reduced dryer capacity because of the high consistency of the web 33, the foam process allows even distribution of virtually any type of fiber or particle (without excessive "sinking" of high density particles while low density particles do "sink" somewhat—they do not sink at all in water) into the slurry (and ultimately the web) as long as the fibers or particles have a specific gravity between about 0.15–13. The foam process also allows the production of a wide variety of basis weight webs, a product with increased uniformity and higher bulk compared to water-laid process products, and a very high level of uniformity. A plurality of headboxes may be provided in sequence, or two (or more) strata may be made at the same time within a headbox with a double wire, etc., and/or the simple coaters 35 may be utilized to provide additional layers with great simplicity (like coating).

Figure 2:
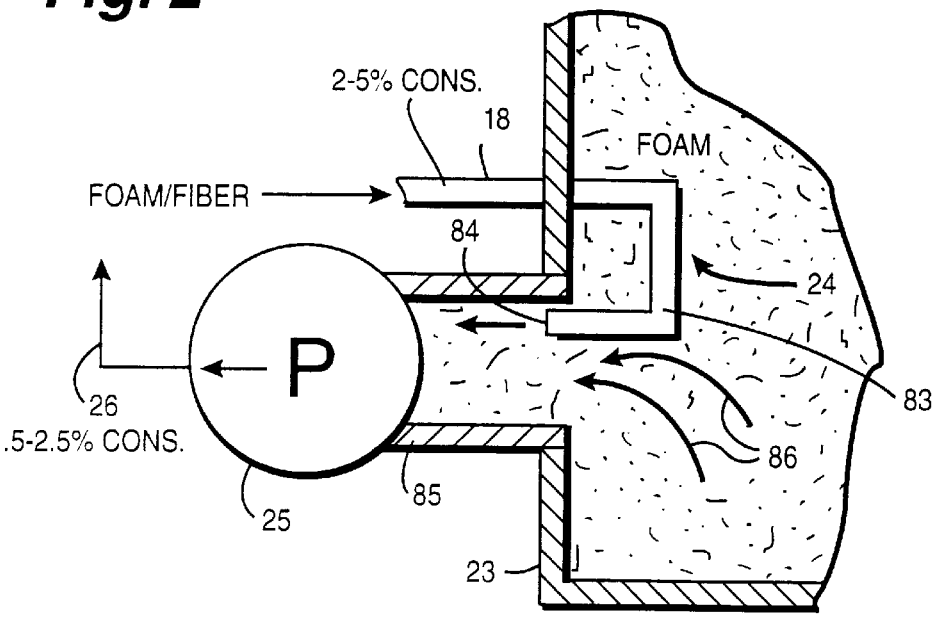
FIG. 2 is a detail schematic view, partly in cross-section and partly in elevation, showing the feed of a foam/fiber slurry from the mixer to the pump feeding the manifold and headbox of the system of FIG. 1.

FIG. 2 shows the introduction of foam/fiber mixture, and foam, to the pump 25 associated with the wire pit 23. The structure 24 is known from the Wiggins Teape process such as disclosed in the patents incorporated by reference herein, and the foam/fiber passing in line 18 is caused to be redirected as illustrated by the bent conduit 83 so that from the open end 84 thereof the foam/fiber mixture is discharged directly into the intake 85 of the pump 25. Foam from the wire pit 23 also flows into the inlet 85, as illustrated by arrows 86. Operation of pump 48, done under fuzzy control; controls the level in wire pit 23.

Where the fibers to be used to make the foam are particularly long, that is on the order of several inches, instead of directing the line 18 to the suction inlet 85 of the pump 25 (as seen in FIG. 2) the line 18 terminates in the line 26 downstream of the pump 25. In this case the pump 17 must of course provide a higher pressure than it otherwise would, that is sufficient pressure so that the flow from 18 is into the line 26 despite the pressure in line 26 from the pump 25.

Figure 3:
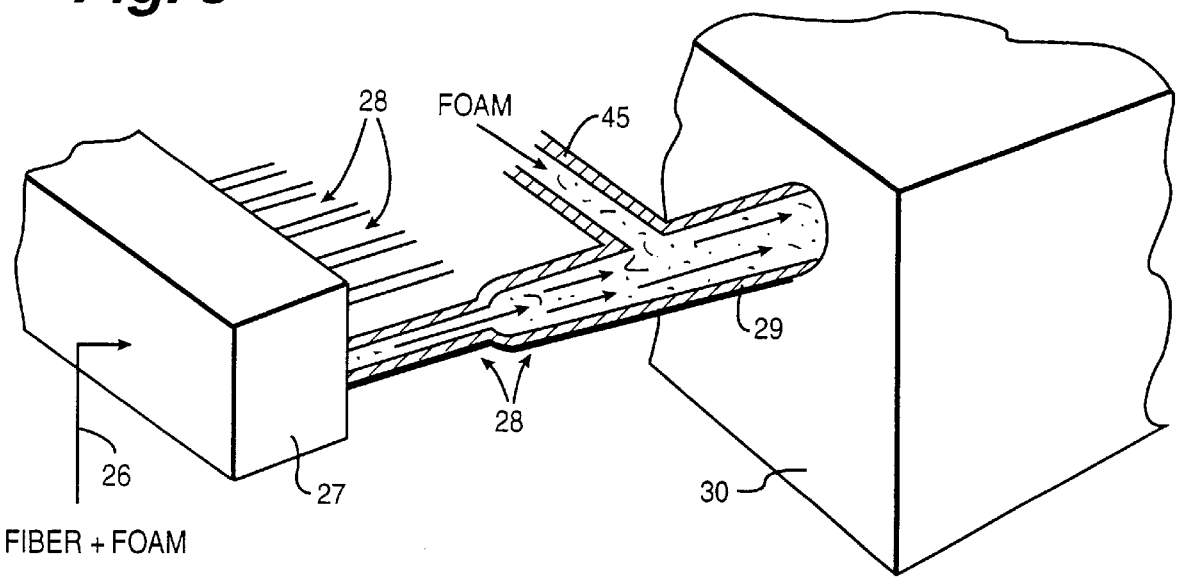
FIG. 3 is a perspective schematic detail view, partly in crosssection and partly in elevation, showing the addition of foam per se into the conduit between the manifold and the headbox, according to the invention.

FIG. 3 illustrates the details of one form of an additional foam introduction aspect of the process of the invention. FIG. 3 illustrates foam per se from lines 45 being introduced into the foam/fiber mixture in the conduit 29 just prior to the headbox 30. When foam injection lines 45 are utilized they need not inject foam into all of the lines 29, just enough of them to achieve the desired results. The desired results include (as a primary advantage) a more uniform basis weight profile. If desired the tubes 29 can lead the foam from the foam nozzles 28 to an explosion chamber in the headbox 30. However there is no real reason to use an explosion chamber in the headboxes for practicing the Ahlstrom process. If used, an explosion chamber is solely for security.

The amount of pure foam added in lines 45, and exactly where it is added, must be determined empirically for each situation, being dependent upon the particular headbox 30 and other equipment used, the type and size of the fibers, and other variables. Under most circumstances the addition of pure foam that is somewhere between about 2–20% of the volume of the foam/fiber mixture gets the desired results.

Figure 4:
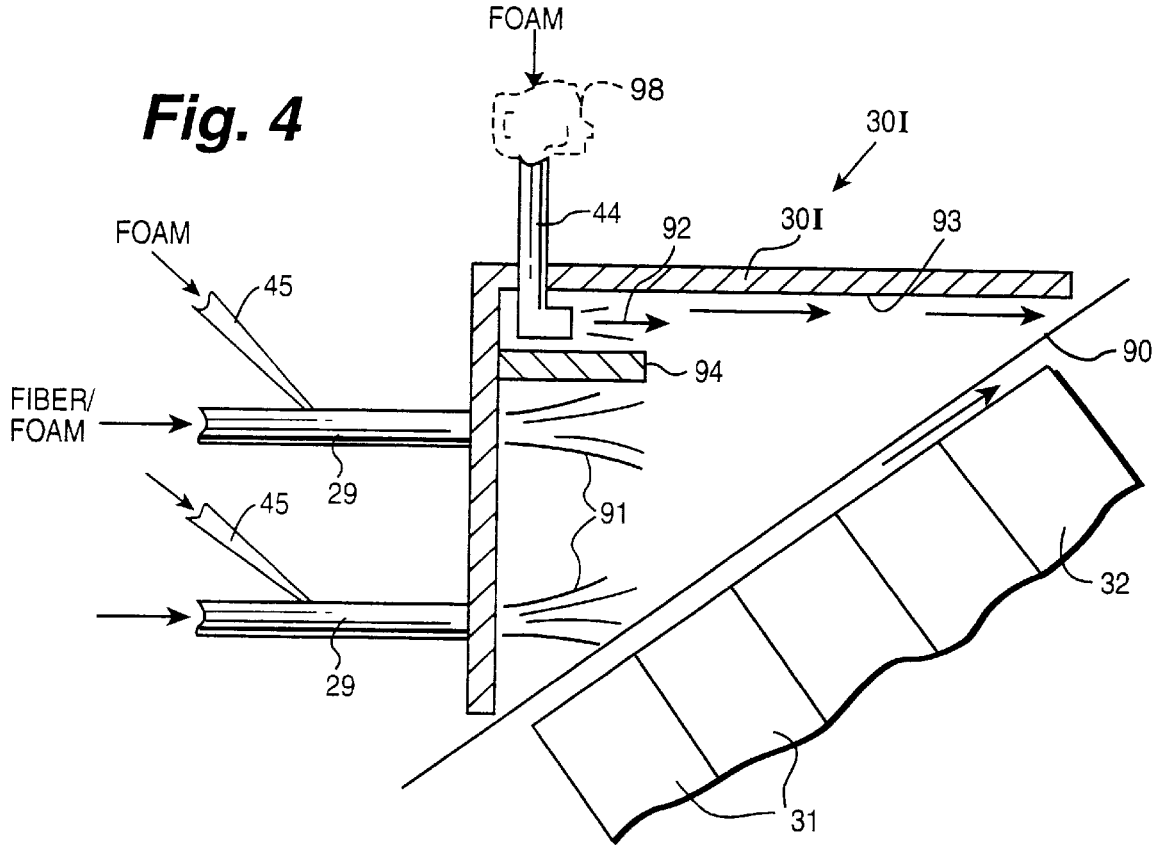
FIG. 4 is a side view, partly in cross-section and partly in elevation, of a detail of an exemplary inclined wire headbox utilizing the teachings of the present invention, and for practicing a method according to the present invention.

FIG. 4 illustrates an exemplary incline wire headbox, 30I, which utilizes two different forms of foam injection (the form illustrated in FIG. 3 plus another). In the headbox 30I of FIG. 4 the inclined conventional forming wire 90 moves in the direction of the arrow, and with foam injection at 45 the foam/fiber mixture is dispersed in to the headbox 30I from the conduits 29 generally as illustrated in FIG. 4. Foam is also introduced into headbox 301 via conduit 44 so that the foam flows generally as illustrated at arrow 92 in FIG. 4. That is the foam flowing in the direction of arrow 92 flows against the bottom of the roof 93 of the headbox 30I. A baffle 94 may be provided in the headbox 30I to ensure the initial flow of the foam in the direction 92 from each of a plurality of the conduits 44.

The incline (e.g. about 45°) of the headbox 30I is preferred for a number of reasons. If the roof 93 of the headbox 301 is inclined upwardly in the direction of movement of the wire 90 any gas bubble formed at the top of headbox 30I will pass out of the headbox 30I on its own. If the wire 90 forming the bottom of the headbox 30I is horizontal the gas bubble will remain at the top of the headbox 30I, and a special structure (e.g. valved conduit and/or pump) must be provided to remove it.

One reason the substantially pure foam is introduced in one or more conduits 44 is for the purpose of providing less shear of fibers in the headbox 30I so that the fibers in the slurry do not become unidirectional (generally in the direction of the movement of the wire 90). Under basic fluid dynamic principles, if the foam/fiber mixture is against the roof 93 the friction will cause the fiber orientation at the boundary layer to become unidirectional, which is undesirable. The foam introduced to flow in the direction 92 eliminates that boundary layer problem, acting as a lubricant.

The foam introduced in lines 44 may also have a desirable effect on the basis weight profile of the foam/fiber slurry 91. Also the foam introduced in lines 44 flowing in direction 92 keeps the bottom of the roof 93 clean, which is also desirable.

The amount of foam introduced in this way (via conduits 44) also must be determined empirically in each different situation, but normally the optimum will be somewhere within the range of about 1–10% of the volume of the foam/fiber mixture introduced by conduits 29.

Figure 5:
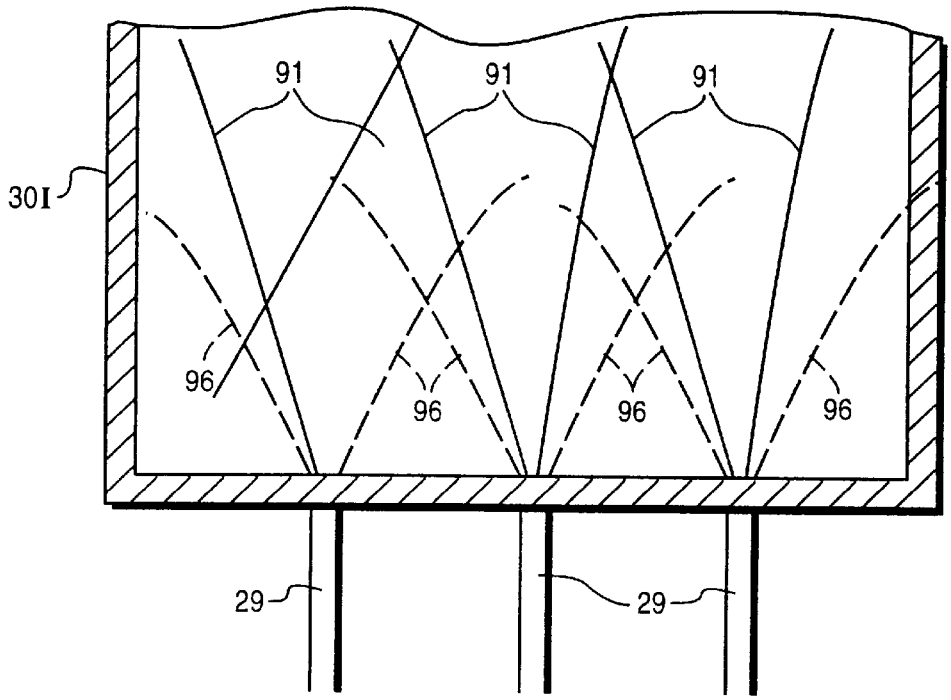
FIG. 5 is a schematic representation illustrating the affect of pure foam addition to the conduits leading from the manifold to the headbox.

The introduction of the foam in conduits 45 (typically at an angle of between about 30–90° —compare FIGS. 3 and 4) as illustrated in both FIGS. 3 and 4, is for a different purpose. FIG. 5 is a schematic top view (showing only three conduits 29, whereas normally very many are provided) of the headbox 30 (e.g. 30I) showing the difference pure foam injection makes. Without the injection of substantially fiber-free foam at 45 the foam/fiber mixture introduced by conduits 29 is distributed generally as indicated by lines 91 in FIGS. 4 and 5. However when there is foam injection at 45, the basis weight profile is changed because there is a greater dispersion of the foam fiber mixture, as schematically indicated by lines 96 in FIG. 5. The affect on the basis weight profile is seen in the schematic illustration in FIG. 6. The normal basis weight profile (when there is no foam injection), illustrated by line 91A, includes a large bulge 97. However when there is foam injection, as indicated by line 96a the bulge 98 is much smaller. That is, the basis weight is more uniform. Profile control is effected by adding the diluting foam at the manifold 27 main flow (e.g. before nozzles 28), or just before or just after the tubes 29 enter headbox 30I Oust before being seen at 45 in FIG. 4), i.e. after nozzles 28.

If desired the tubes 29 can lead the foam from the foam nozzles 28 to an explosion chamber in the headbox 30, 30I. However there is no real reason to use an explosion chamber in the headboxes for practicing the process of the invention. If used, an explosion chamber is solely for security.

As seen in dotted line in FIG. 4, a foam nozzle 98 may be provided in some or all of the conduits 44. Also, the basis weight profile may be adjusted using the foam flow 92 (alone or in combination with the flow in conduits 45). The conduits 44 may branch, one branch in direction 92, and another to intersect flows 91 (with baffle 94 removed, or penetrated by the second branch).

Utilizing the assemblies illustrated in FIGS. 3 through 5 it will be seen that the advantageous methods according to the invention may be practiced. According to one method the following steps are practiced: (a) A first foam slurry of air, water, fibers (e.g. synthetic and cellulosic fibers, although other fibers, such as glass fibers can be used), and any suitable surfactant, is fed into the headbox 30I and into contact with the moving foraminous element 90. (b) A first substantially fiber-free foam is introduced—as indicated by the arrow 92 in FIG. 4—into contact with the surface 93 (e.g. the roof of the headbox 30I at a point remote from the foraminous element 90. Step (b) is typically practiced to cause foam to flow along the surface 93 toward the element 90 so as to minimize shear of fibers in the headbox 30I so that the fibers do not become unidirectional, in the general direction of movement of the foraminous element 90, and also so as to keep the surface 93 clean. And there is the step (c) of withdrawing foam through the foraminous element 90 to form a non-woven fibrous web on the element 90, withdrawal of foam being accomplished utilizing the suction boxes 31, 32 or any other suitable conventional device for that purpose (such as suction rollers or tables, pressing rolls, or the like).

Figure 6:
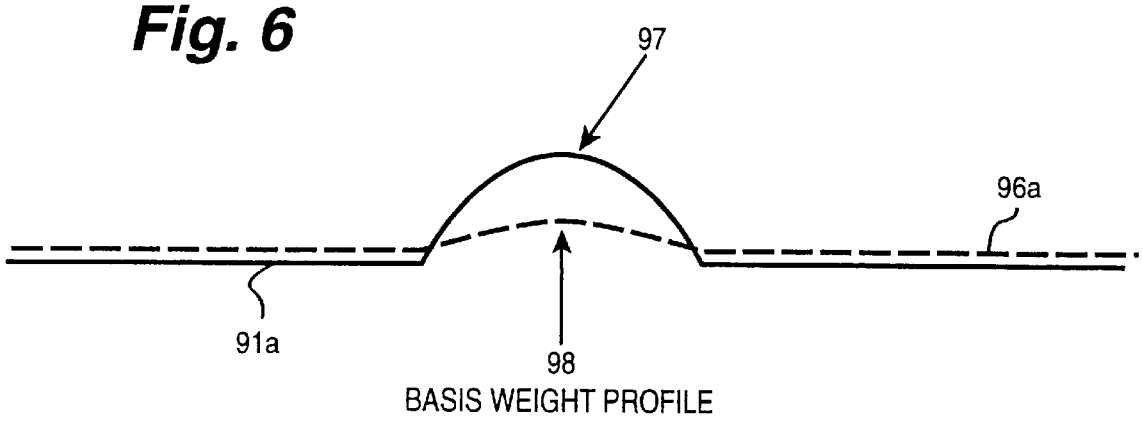
FIG. 6 is a schematic representation of the basis weight profile of the headbox of FIGS. 4 and 5 with and without pure foam addition.

There is also a method—which can be seen in all of FIGS. 3 through 5—that includes the following steps: (a) Feeding a first fiber-foam slurry, such as through the conduits 29 seen in FIGS. 3 and 4 (e.g. with the flow 91 in basically the same direction of the flow 92 in FIG. 4); (b) withdrawing the foam through the element 90 (such as described above); and (c) passing a second, substantially fiber-free foam, into the first foam slurry (as indicated at 45 in both FIGS. 3 and 4) near where the first foam slurry is fed into the headbox 30, 30I (typically at manifold 27, or up to just past the point of introduction thereof) so as to provide a more uniform basis weight profile of the non-woven web produced (as seen in FIG. 6).

In the practice of the method according to the present invention, and utilization of the system, typical foam-laid process parameters that may be utilized are set forth in the following table (although the range of parameters can be wider if a product range is wider):

| PARAMETER | VALUE |
|---|---|
| pH (substantially entire system) | About 6.5 |
| temperature | About 20–40° C. |
| manifold pressure | 1–1.8 bar |

-continued

| PARAMETER | VALUE |
|---|---|
| consistency in mixer | 2.5% |
| consistency in headbox | .5–2.5% |
| SAP additive consistency | About 5–20% |
| consistency of formed web | About 40–60% |
| web basis weight variations | Less than ½% |
| foam density (with or without fibers) | 250–450 grams per liter at 1 bar |
| foam bubble size | .3–.5 mm average diameter (a Gaussian distribution) |
| form air content | 25–75% (e.g. a 60%; changes with pressure in the process) |
| viscosity | there is no "target" viscosity, but typically the foam has viscosity on the order of 2–5 centipoises under high shear conditions, and 200 k–300 k centipoises at low shear conditions, which ranges may be wider depending on the manner of determining viscosity. |
| web formation speed | about 200–500 meters per minute |
| specific gravity of fibers of additives | anywhere in the range of .15–13 |
| surfactant concentration | depends on many factors, such as water hardness, pH, type of fibers, etc. Normally between 0.1–0.3% of water in circulation |
| forming wire tension | between 2–10 N/cm |
| exemplary flow rate | |
| mixer to wire pit | about 4000 liters per minute |
| wire pit to headbox | about 40,000 liters per minute |
| foam recycle conduit | about 3500 liters per minute |
| suction withdrawal to water recycle | about 500 liters per minute |

It is the primary object of the present invention to provide highly advantageous modifications of the foam-laid process. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and assemblies.

What is claimed is:

1. A headbox assembly for producing a non-woven web of fibrous material comprising:

a moving foraminous element on which a non-woven web may be formed;

a headbox comprising a first surface and a second surface, said second surface remote from said foraminous element, and said headbox adjacent said foraminous element so that a foam fiber mixture in said headbox deposits fibers on said foraminous element;

means for introducing a foam fiber mixture into said headbox;

means for withdrawing foam through said foraminous element to form a non-woven fibrous web on said foraminous element; and means for passing a substantially fiber free foam into contact with said second surface at a position remote from said foraminous element.

2. A headbox assembly as recited in claim 1 further comprising means for introducing substantially fiber free foam into said means for introducing a foam fiber mixture into said headbox just prior to said headbox so as to provide a more uniform basis weight profile of the non-woven web produced.

3. A headbox assembly as recited in claim 2 wherein said means for passing a substantially fiber free foam into contact with said second surface at a position remote from said foraminous element comprises a conduit opening adjacent said second surface for causing foam to flow along said second surface toward said foraminous element so as to minimize shear of fibers in said headbox so that the fibers do not become unidirectional, in the direction of movement of said foraminous element, and keeps said second surface clean.

4. A headbox assembly as recited in claim 1 wherein said means for introducing a foam-fiber mixture into said headbox includes openings in said first surface.

5. A headbox assembly as recited in claim 4, wherein said means for passing a substantially fiber free foam into contact with said second surface at a position remote from said foraminous element comprises a conduit opening adjacent said second surface for causing foam to flow along said second surface toward said foraminous element so as to minimize shear of fibers in said headbox so that the fibers do not become unidirectional, in the direction of movement of said foraminous element, and keeps said second surface clean.

6. A headbox assembly as recited in claim 1 wherein said means for passing a substantially fiber free foam into contact with said second surface at a position remote from said foraminous element comprising at least one conduit opening adjacent said second surface for causing foam to flow along said second surface toward said foraminous element so as to minimize shear of fibers in said headbox so that the fibers do not become unidirectional.

7. A headbox assembly as recited in claim 6, further comprising a baffle adjacent said means for passing a substantially fiber free foam into contact with said second surface at a position remote from said foraminous element to ensure initial flow of the introduced foam along said second surface.

8. A headbox assembly as recited in claim 6, wherein said second surface is a roof surface of said headbox, and wherein said foraminous element moves at an angle to both the horizontal and vertical, said headbox being an inclined headbox.

9. A method of producing a non-woven web of fibrous material, using a headbox, a moving foraminous element, and a surface of the headbox, said method comprising the steps of:

(a) feeding a first foam slurry of air, water, fibers, and surfactant into the headbox and into contact with the moving foraminous element;

(b) passing a lubricant of a first substantially fiber free foam into contact with the surface of the headbox at a point remote from the foraminous element; and (c) withdrawing foam through the foraminous element to form a non-woven fibrous web on the foraminous element.

10. A method as recited in claim 9 wherein step (b) is practiced to cause the lubricant to flow along the surface toward the moving foraminous element so as to minimize shear of fibers in the headbox so that the fibers do not become unidirectional, in the direction of movement of the foraminous element.

11. A method as recited in claim 9 wherein the surface of the headbox comprises a roof surface thereof, and wherein step (b) is practiced, to cause foam to flow along the surface toward the foraminous element so as to also keep the surface clean.

12. A method as recited in claim 9 comprising the further step of passing a second substantially fiber-free foam into the first foam slurry just before the first foam slurry is fed into the headbox so as to provide a more uniform basis weight profile of the non-woven web produced.

13. A method as recited in claim 9 wherein step (a) is practiced so that the first fiber-foam slurry flows in substantially the same direction as the first substantially fiber-free foam.

14. A method as recited in claim 13 wherein step (b) is practiced by providing a baffle in the headbox which assists in directing the first substantially fiber-free foam along the surface, and so that it does not initially mix with the first fiber-foam slurry introduced into the headbox.

15. A method as recited in claim 9 wherein steps (a) and (b) are practiced so that the volume of the substantially fiber/free foam in step (b) is between about 1–10% the volume of the fiber/foam mixture in step (a).

16. A method of producing a non-woven web of fibrous material, using a headbox, and a moving foraminous element, comprising the steps of:

(a) feeding a first foam slurry of air, water, fibers, and surfactant into the headbox and into contact with the moving foraminous element;

(b) withdrawing foam through the foraminous element to form a non-woven fibrous web on the foraminous element; and (c) passing a second, substantially fiber-free foam, into the headbox to provide a more uniform basis weight profile of the non-woven web produced.

17. A method as recited in claim 16 wherein step (c) is practiced by introducing the second foam into the first foam flow near where the first foam slurry is fed into the headbox.

18. A method as recited in claim 16 wherein steps (a)–(c) are practiced to produce a non-woven web having a consistency before drying of about 40–60%, and a basis weight variation of less than ½%.

19. A method as recited in claim 16 wherein the volume of the flow in step (c) is between about 2–20% the volume of the flow in step (a).

20. A method as recited in claim 16 wherein step (c) is practiced by introducing the second foam into the first foam flow just before the headbox.

21. A headbox assembly comprising:

a headbox associated with a moving foraminous element;

means for feeding a first foam slurry of air, water, fibers, and surfactant into the headbox and ultimately into contact with the moving foraminous element;

means for withdrawing foam through the foraminous element to form a non-woven web on the foraminous element; and means for passing a second, substantially fiber-free foam, into the first foam slurry near where the first foam slurry is fed into the headbox.

22. An assembly as recited in claim 21 wherein said means for feeding a first foam slurry of air, water, fibers, and surfactant into the headbox and ultimately into contact with the moving foraminous element comprises a plurality of foam forming nozzles and a plurality of first conduits connecting said nozzles to said headbox; and wherein said means for passing a second, substantially fiber-free foam, into the first foam slurry just before the first foam slurry is fed into the headbox comprises a plurality of second conduits associated with at least some of said first conduits and making an angle with respect thereto just before said headbox.

* * * * *